United States Patent [19]

Waugh et al.

[11] 4,335,327

[45] Jun. 15, 1982

[54] X-RAY TUBE TARGET HAVING PYROLYTIC AMORPHOUS CARBON COATING

[75] Inventors: John S. Waugh, Wellesley, Mass.; Richard G. Weber, Stamford, Conn.

[73] Assignee: The Machlett Laboratories, Incorporated, Stamford, Conn.

[21] Appl. No.: 141,525

[22] Filed: Apr. 18, 1980

Related U.S. Application Data

[63] Continuation of Ser. No. 965,764, Dec. 4, 1978, abandoned.

[51] Int. Cl.[3] ..... H01J 35/08

[52] U.S. Cl. ..... 313/330; 313/311; 313/55; 427/65

[58] Field of Search ..... 313/60, 330, 311, 55; 427/65, 160

[56] References Cited

U.S. PATENT DOCUMENTS

| | | | |
|---|---|---|---|
| 2,863,083 | 12/1958 | Schram | 313/330 |
| 3,969,131 | 7/1976 | Fatzer et al. | 313/330 |
| 4,090,103 | 5/1978 | Machenschalk | 313/330 |

FOREIGN PATENT DOCUMENTS

| | | | |
|---|---|---|---|
| 752025 | 1/1967 | Canada | 313/60 |
| 2117956 | 11/1972 | Fed. Rep. of Germany | 313/330 |
| 2146918 | 3/1973 | Fed. Rep. of Germany | 313/330 |
| 2152049 | 4/1973 | Fed. Rep. of Germany | 313/60 |
| 50-105173 | 3/1977 | Japan | 313/60 |

*Primary Examiner*—Saxfield Chatmon, Jr.
*Attorney, Agent, or Firm*—John T. Meaney; Joseph D. Pannone

[57] ABSTRACT

An X-ray tube including a tubular envelope having therein an anode target provided with a surface portion made of X-ray emissive material and with another surface portion coated with amorphous carbon material, and an electron emitting cathode disposed to beam electrons onto the surface portion of the target made of X-ray emissive material.

11 Claims, 3 Drawing Figures

X-RAY TUBE TARGET HAVING PYROLYTIC AMORPHOUS CARBON COATING

CROSS-REFERENCE TO RELATED CASES

This is a continuation of application Ser. No. 965,764, filed Dec. 4, 1978, now abandoned.

BACKGROUND OF THE INVENTION

1. Field of the Invention

This invention relates generally to X-ray tubes and is concerned more particularly with a rotatable anode target having a surface coating of amorphous carbon material.

2. Discussion of the Prior Art

Generally, an X-ray tube includes an evacuated envelope having therein an electron emitting cathode disposed to beam high energy electrons onto an aligned focal spot area of a spaced anode target. The target may comprise a rotatable disc having adjacent its outer periphery an annular focal track made of X-ray emissive material, such as tungsten-rhenium alloy, for example. Thus, electrons beamed from the cathode may be focused onto a focal spot surface area of the focal track to penetrate into the underlying material thereof and generate X-rays which pass in a beam out of the tube. Most of the electron energy incident on the focal spot area is converted into heat energy which may become excessive and damage the surface of the focal track. Consequently, the target disc is rotated at a suitable high angular velocity for moving material of the annular focal track rapidly through the focal spot area aligned with the electron beam.

The focal track may comprise a layer of X-ray emissive material annularly disposed on the disc surface adjacent the electron emitting cathode. Therefore, the substrate disc may be made of a suitable lightweight material, such as molybdenum alloy or graphite, for examples, to reduce the inertia of the target and aid it in attaining a desired high angular velocity in a relatively short time interval. Also, the focal track layer may be provided with an optimum thinness for the underlying material of the disc to function as an efficient heat sink in conducting heat away from the electron bombarded material of the focal track. Thus, heat energy is accumulated in the body of the substrate disc for dissipation to surrounding structure of the tube before becoming sufficiently excessive to cause warping or cracking of the target.

However, the target disc generally is mounted for axial rotation by having a central portion thereof attached to a stem end portion of a magnetic induction rotor supported by bearings in the envelope. The stem end portion usually is provided with a suitable cross-sectional configuration for restricting the flow of heat from the target disc to the rotor in order to prevent damage to the support bearings. Consequently, the heat energy accumulated in the target disc cannot be dissipated efficiently by conduction through adjacent structure, and cannot be dissipated by convection since the tube envelope is evacuated. Therefore the heat stored in the body of the target disc must be dissipated predominantly by radiation to the tube envelope, which may be fluid-cooled.

Attempts have been made in the prior art to improve the radiation of heat from the disc to the envelope by providing the target with a surface coating of heat emissive material. However, these prior art target coating materials generally have proved unsatisfactory for numerous reasons, such as poor adherence under thermomechanical and electrostatic stress, poor transfer of heat from the disc to the coating and, inadequate thermal characteristics of the coating material, for examples. As a result of poor adherence or poor thermal characteristics, particles of the coating may break away from the target disc. Also, if the substrate disc is made of graphite, carbon dust may be pulled away therefrom by the electrostatic field established between the anode target and the cathode. Thus, loose particles of the coating may be deposited between highly charged electrodes of the tube, or carbon dust may deposit on dielectric surfaces within the envelope. As a result, high voltage arc-over may occur within the envelope, and may cause catastrophic failure of the tube.

Therefore, it is advantageous and desirable to provide an X-ray tube with a target having a tightly adherring coating of heat emissive material, which also prevents the liberation of loose particles within the envelope.

SUMMARY OF THE INVENTION

Accordingly, this invention provides an X-ray tube including a tubular envelope having therein an electron emitting cathode disposed to beam electrons onto a focal spot area of a spaced anode target provided with a surface coating of amorphous carbon material outside of the focal spot area. In contrast to graphite, which has an ordered crystalline structure and a thermal emissivity of about sixty-four hundredths, amorphous carbon material has a non-ordered crystalline structure and a higher thermal emissivity of about seventy-nine hundredths. Also, the thermal emissivity of amorphous carbon material is superior to the thermal emissivities of other conventional target materials, such as molybdenum which has an emissivity of about twenty-five hundredths and tungsten which has an emissivity of about thirty hundredths, for examples.

The amorphous carbon material preferably is deposited from a gaseous phase, such as by pyrolysis, for example, to line the walls of any pores and crevices is exposed surfaces of the target. Thus, after masking selected surface areas by conventional means, the target is placed in a suitable furnace chamber, such as a tube furnace, for example, which then is evacuated and heated to a temperature greater than twelve hundred degrees Centigrade and less than eighteen hundred degrees Centigrade. It is well-known that between eighteen hundred degrees Centigrade and twenty-two hundred degrees Centigrade amorphous carbon rapidly crystallizes to form graphite. Therefore, during the deposition process, it is important that the temperature of the target be maintained below eighteen hundred degrees Centigrade.

With the temperature of the target stabilized at a preferred value, such as fifteen hundred degrees Centigrade, for example, a carbonaceous gas, such as methane, for example, is flowed through the furnace chamber and over the heated target. As a result, amorphous carbon material deposits out of the gas and onto exposed surface areas of the target. If desired, the carbonaceous gas may be mixed with a dilutent inert gas, such as argon, for example, to avoid excessive concentrations of deposited amorphous carbon material and produce a smooth even coating. After a predetermined interval of time suitable for providing an amorphous carbon coating of a desired thickness, such a one ten-thousandth to one thousandth of an inch, for example, the deposition process may be terminated by cutting-off the flow of carbonaceous gas and allowing the furnace chamber to cool to room temperature. The resulting amorphous carbon coating on exposed surface areas of the target is strongly adherrent and resists abrasion. Consequently, the coating of amorphous carbon material not only improves the thermal emissivity of the target, but also withstands thermo-mechanical and electrostatic forces exerted on it during operation of the X-ray tube.

The anode target preferably comprises a rotatable disc having adjacent its outer periphery an annular focal track made of X-ray emissive material and having a surface coating of amorphous carbon material outside of the focal track. Thus, the target disc may be made of relatively lightweight material, such as molybdenum alloy or graphite, for examples, and have annularly disposed adjacent its outer periphery a focal track layer of X-ray emissive material, such as tungsten-rhenium, for example. If the amorphous carbon material adheres strongly to a disc material, such as graphite, for example, the focal track layer may be applied to the disc either before or after applying the coating of amorphous carbon material. The amorphous carbon coating may be applied to all surfaces areas of the disc outside of the focal track layer to provide not only surfaces having greater thermal emissivity, but also an anti-dust coating which prevents particles of graphite from becoming separated from the target.

On the other hand, if the amorphous carbon material does not adhere strongly to a disc material, such as molybdenum, for example, the disc may be initially coated with a mutually adherrent material, such as the tungsten-rhenium material of the focal track layer, for example. Then, the annular focal track area may be masked; and the amorphous carbon material may be coated on areas of the tungsten-rhenium material outside of the focal track area to provide a strongly adherrent coating of higher thermal emissivity material. Consequently, as an alternative embodiment, the target disc may be made of X-ray emissive material, such as tungsten-rhenium alloy material, for example, and have surface areas thereof outside an annular focal track area adjacent its outer periphery provided with a higher emissivity coating of amorphous carbon material.

BRIEF DESCRIPTION OF THE DRAWINGS

For a better understanding of this invention, reference is made in the following detailed description to the drawing wherein.

DESCRIPTION OF THE PREFERRED EMBODIMENT

Figure 1:
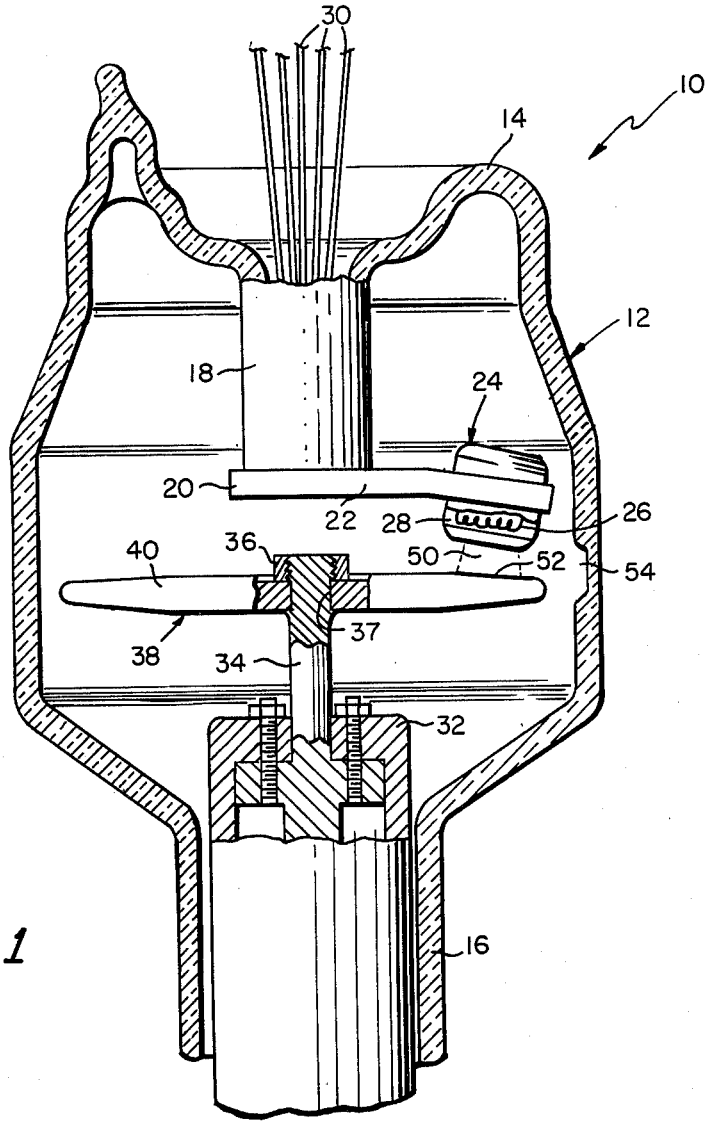
FIG. 1 is a fragmentary axial view, partly in section, of an X-ray tube embodying the invention.

Referring to the drawing wherein like characters of reference designate like parts, there is shown in FIG. 1 an X-ray tube 10 of the rotating anode type having a tubular envelope 12 which may be made of dielectric vitreous material, such as glass, for example. Envelope 12 is provided with a reentrant end portion 14 and an opposing neck portion 16. The reentrant end portion 14 of envelope 12 is peripherally attached to a cathode support sleeve 18 made of rigid material, such as Kovar, for example. Cathode sleeve 18 extends axially within the envelope 12 and has an inner end provided with a cap 20 which supports a radially extending, hollow arm 22.

The arm 22 is angulated with respect to the axis of cathode sleeve 18 and supports on a distal end portion thereof a conventional cathode head 24. Cathode head 24 generally includes an electron emitting filament 26 which is longitudinally disposed within a grid-type focusing cup 28. Electrical conductors 30 extend hermetically through the envelope and insulatingly through the hollow arm 22 for suitable connection to the filament 26 and the focusing cup 28 in a well-known manner.

Sealed within the neck portion 16 of envelope 12 is a bearing mounted rotor 32 of a magnetic-type induction motor, (the external stator of which is not shown). The rotor 32 extends axially within envelope 12 and has attached to its inner end an axially extending stem 34. Stem 34 supports a transversely disposed anode target 38 having a central aperture 37 through which extends a threaded end portion of the stem 34. The target 38 is fixedly attached to the stem 34, as by a hex nut 36 engaging the threaded end portion of stem 34, for example, and is rotated by the rotor 32 in a well-known manner.

Figure 2:
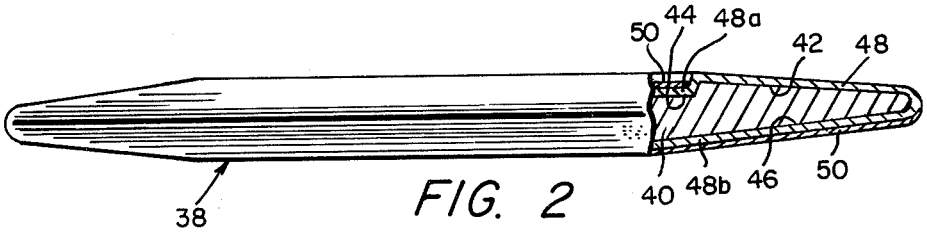
FIG. 2 is an enlarged elevational view, partly in section, of one embodiment of the X-ray target of this invention.

As shown in FIG. 2, the anode target 38 may comprise a substrate disc 40 having a surface disposed in spaced opposing relationship with the cathode 24 and including an annular central portion 44 encircled by an annular marginal portion 42. The marginal portion 42 is sloped radially toward the outer periphery of disc 40 where it is joined to an opposing surface 46 of the disc. Disposed on the marginal surface portion 42 is an annular focal track 48 comprising a layer of efficient X-ray emissive material, such as tungsten-rhenium alloy, for example, which is mechanically and thermally coupled to the material of disc 40 by suitable means, such as chemical vapor deposition, for example.

The disc 40 may be made of suitable lightweight material, such as a molybdenum alloy including titanium and zirconium, for example. However, the thermal emissivity of molybdenum is only about twenty-five hundreds as compared to the emissivity of an ideal black body. Consequently, in the prior art, surface portions of the target disc, outside of the focal track, generally are coated with a higher thermal emissivity material, such as tungsten which has an emissivity of about thirty hundreds, for example. In accordance with this invention, the target disc 40 is provided with still greater thermal emissivity by coating surface portions outside of the focal track 48 with amorphous carbon material, which has a heat emissivity of about seventynine hundreds. However, molybdenum does not form a sufficiently strong bond with amorphous carbon material, whereas the tungsten-rhenium material of focal track layer 48 is strongly adherrent to both molybdenum and amorphous carbon material. Therefore, in this instance, the tungsten-rhenium material of focal track layer 48 may advantageously extend beyond the marginal surface portion 42 of substrate disc 40 to include a layer portion 48*a* disposed on central surface portion 44 and a layer portion 48*b* disposed on the opposing surface 46 of the disc. Subsequently, the respective surfaces of layer portions 48*a* and 48*b* are provided with a heat emissive coating 50 of amorphous carbon material.

Figure 3:
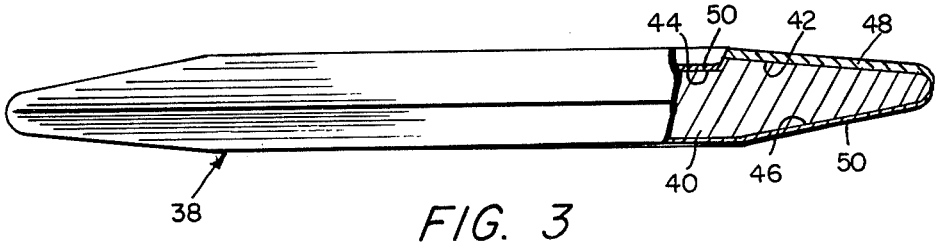
FIG. 3 is an enlarged elevational view, partly in section, of an alternative embodiment of the X-ray target of this invention.

Alternatively, as shown in FIG. 3, the disc 40 may be made of a suitable lightweight material, such as graphite, for example which forms a sufficiently strong bond with amorphous carbon material. Consequently, a heat emissive coating 50 of amorphous carbon material may be applied directly to the central surface portion 44 and the opposing surface 46 of the disc 40. Also, the focal track layer 48 need not extend beyond the marginal surface portion 42 of disc 40, and may be applied either before or after applying the amorphous carbon material of coating 50. Since the graphite material of disc 40 has a thermal emissivity of sixty-nine hundreds, the coating 50 of amorphous carbon material which has a higher emissivity of seventy-nine hundreds, significantly improves the capability of target 38 in dissipating heat from the focal track layer 48. Also, the strongly adherent coating 50 of amorphous carbon material constitutes an anti-dust coating which prevents the separation of graphite particles from the disc 40.

The amorphous carbon material of coating 50 is mechanically and thermally coupled to the material of disc 40, either directly or through an interposed layer of mutually adherent material, by suitable means, such as pyrolysis, for example. Thus, the disc 40 may have the focal track 48 thereof masked by convenient means such as a graphite annulus, for example, and be placed in a conventional tube furnace (not shown). The furnace is evacuated and heated to a temperature greater than twelve hundred degrees Centigrade but less than eighteen hundred degrees Centigrade. Since amorphous carbon graphitizes rapidly between eighteen hundred degrees Centigrade and twenty-two hundred degrees Centigrade, it is important that the disc 40 not be maintained above eighteen hundred degrees Centigrade during the deposition process.

When the disc 40 has stabilized at a preferred temperature, such as fifteen hundred degrees Centigrade, for example, a carbonaceous gas, such as methane, for example, is flowed through the furnace and over the heated disc 40. As a result, amorphous carbon deposits out of the gas to line walls of any pores and crevices in exposed surfaces of the disc 40 and produces thereon a smooth even coating 50, which preferably has a black matte finish. Preferably, the carbonaceous gas is mixed with dilutent inert gas, such as argon, for example, to avoid excessive concentrations of deposited amorphous carbon material. The deposition process is continued for a predetermined time interval to provide the coating 50 with a desired thickness, such as one ten-thousandth to one thousandth of an inch, for example. The resulting coating 50 is strongly adherrent to the material of disc 40 or an interposed layer of mutually adherrent material, and resists abrasion. Consequently, the coating 50 is enabled to withstand thermo-mechanical and electrostatic stresses which tend to separate particles of the disc 40 from the target 38. Also, the amorphous carbon material of coating 50 provides greater thermal emissivity, as compared to conventional target materials of the prior art, for dissipating heat developed in the focal track layer 48 during operation of the X-ray tube 10.

In operation, electrical energy supplied through the conductors 30 heats the filament 26 of cathode 24 to an electron emitting temperature, and maintains the focusing cup 28 at a suitable electrical potential for directing the emitted electrons into a beam 51 which impinges on an aligned focal spot area 52 of the focal track 48. The focal spot area 52 may be of conventional size, such as one millimeter wide by five millimeters extended radially along the slope of focal track 48, for example. Also, the anode target 38 is maintained at a sufficiently high electrical potential, such as eighty-thousand volts, for example, with respect to the cathode filament 26 to accelerate electrons in the beam 51 to high kinetic energy levels. As a result, the electrons impinging on the focal spot surface area 52 penetrate into the underlying material of focal track layer 48 to generate X-rays. Thus, X-rays radiate from the focal spot area 52 and pass in a beam (not shown) through a radially aligned window 54 of X-ray transparent material in envelope 12.

However, most of the electron energy incident on the focal spot area 52 is converted into heat within the underlying material of focal track 48. Consequently, the target disc 38 is rotated at an appropriately high angular velocity, such as ten thousand revolutions per minute, for example, to move successive segments of the annular focal track 48 rapidly through the focal spot area 52 aligned with electron beam 50. The resulting heat developed in respective segments of the focal track 48, while in the focal spot area 52, is conducted to relatively cooler portions of the target disc 40 outside of the focal track. In this manner, the segments of focal track 48, when rotated out of the focal spot area 52, may have their respective temperatures reduced to relatively safe values for re-entering the focal spot area.

Thus, heat is accumulated in the body of target disc 40 for dissipation through surrounding structure of the tube before becoming sufficiently excessive to cause damage, such as warping or cracking of the target disc, for example. However, envelope 12 is evacuated, and the stem 32 generally is provided with a minimum cross-sectioned area to restrict the flow of heat to rotor 32 in order to avoid damaging the support bearings thereof. Accordingly, the heat accumulated in the body of target disc 40 is dissipated predominantly by radiation to the envelope 12 which may be cooled by immersion in a dielectric fluid (not shown), such as X-ray transparent oil, for example. As a result, the heat emissivity of target disc 40 is a limiting factor in determining the maximum amount of electron energy that can safely impinge on the focal spot area 52 and, consequently, the maximum X-ray intensity that can be obtained from the tube.

Therefore, in accordance with this invention, surface portions of the disc 40 outside of the focal track 48 are mechanically and thermally coupled to the heat emissive coating 50 of amorphous carbon material, which is more effective than the material of the disc in radiating heat to the envelope 12. Thus, the X-ray tube 10 having the target 38 provided with heat emissive coating 50 of amorphous carbon material may operate at a lower focal track temperature or at a higher continuous input power level, as compared to similar types of prior art X-ray tubes operating under equivalent conditions.

From the foregoing, it will be apparent that all of the objectives of this invention have been achieved by the structures shown and described herein. It also will be apparent, however, that various changes may be made by those skilled in the art without departing from the spirit of the invention as expressed in the appended claims. It is to be understood, therefore, that all matter shown and described is to be interpreted as illustrative and not in a limiting sense.

What is claimed is:

1. An X-ray target comprising:

a body having a first surface portion made of X-ray emissive material and a second surface portion coated with pyrolytic amorphous carbon material.

2. An X-ray target as set forth in claim 1 wherein the first surface portion comprises a surface layer of X-ray emissive material mechanically and thermally coupled to the body.

3. An X-ray target as set forth in claim 3 wherein the body is made of graphite material.

4. An X-ray target as set forth in claim 3 wherein the body is made of molybdenum alloy material.

5. An X-ray tube including:

an evacuable envelope;

an X-ray target body mounted in the envelope and having a first surface portion made of X-ray emissive material and a second surface portion coated with pyrolytic amorphous carbon material; and means disposed in the envelope and spaced from the target body for beaming electrons onto the first surface portion thereof and generating X-rays which pass in a beam out of the tube.

6. An X-ray tube as set forth in claim 5 wherein the target body comprises a rotatable disc.

7. An X-ray tube as set forth in claim 6 wherein the first surface portion comprises an annular focal track layer of the X-ray emissive material mechanically and thermally coupled to the disc adjacent the outer periphery thereof.

8. An X-ray tube as set forth in claim 7 wherein the second surface portion comprises a heat emissive coating of the amorphous carbon material mechanically and thermally coupled to surfaces of the disc outside of the focal track layer.

9. An X-ray tube a set forth in claim 8 wherein the X-ray emissive material of the focal track layer also is disposed between the disc and the heat emissive coating.

10. A method for providing an X-ray target body with a coating of amorphous carbon material and comprising the steps of:

heating the target body to a temperature greater than twelve hundred degrees Centrigrade and less than eighteen hundred degrees Centigrade; and flowing a carbonaceous gas over the target body to cause amorphous carbon material to deposit out of the gas and coat the target body.

11. A method for providing an X-ray target body with a heat emissive coating of amorphous carbon material and comprising the steps of:

masking one or more surface areas of the target body;

placing the target body in a furnace chamber;

heating the target body to a temperature greater than twelve hundred degrees Centigrade and less than eighteen hundred degrees Centigrade; and flowing a carbonaceous gas over the target body to produce a coating of amorphous carbon material on unmasked surface areas of the target body.

* * * * *